US009592984B2

(12) United States Patent
Oonishi

(10) Patent No.: US 9,592,984 B2
(45) Date of Patent: Mar. 14, 2017

(54) IMAGE FORMING APPARATUS WITH A CONVEYANCE SECTION MOVABLE IN A WIDTH DIRECTION

(71) Applicant: Konica Minolta, Inc., Tokyo (JP)

(72) Inventor: Taizou Oonishi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/884,326

(22) Filed: Oct. 15, 2015

(65) Prior Publication Data

US 2016/0109840 A1 Apr. 21, 2016

(30) Foreign Application Priority Data

Oct. 20, 2014 (JP) ..... 2014-213627

(51) Int. Cl.
*G03G 15/00* (2006.01)
*B65H 18/14* (2006.01)

(52) U.S. Cl.
CPC ..... *B65H 18/145* (2013.01); *G03G 15/652* (2013.01); *G03G 15/6567* (2013.01); *G03G 2215/00561* (2013.01)

(58) Field of Classification Search
CPC ..... G03G 15/2028; G03G 15/2064; G03G 21/1647; G03G 15/6517;
(Continued)

(56) References Cited

U.S. PATENT DOCUMENTS 5,774,777 A * 6/1998 Ohtsuka ..... B65H 23/0216 271/228
7,865,126 B2 * 1/2011 Matsuduki ..... B41J 15/046 399/320
(Continued)

FOREIGN PATENT DOCUMENTS

JP 08-119503 A 5/1996
JP 2006076784 A 3/2006
(Continued)

OTHER PUBLICATIONS

Notice of Reasons for Rejection dated Dec. 6, 2016 from corresponding Japanese Application; Japanese Patent Application No. 2014-213627; English translation of Notice of Reasons for Rejection; Total of 6 pages.

*Primary Examiner* — Francis Gray
(74) *Attorney, Agent, or Firm* — Lucas & Mercanti, LLP

(57) ABSTRACT

An image forming apparatus includes: a first conveyance section disposed on an upstream side of the image formation position in a sheet conveyance direction of the long sheet, and configured to convey the long sheet to the image formation position; a second conveyance section disposed on a downstream side of the image formation position in the sheet conveyance direction, and configured to convey the long sheet on which the toner image is formed; a displacement detection section configured to detect displacement of the long sheet in a sheet width direction; and a control section configured to move the first conveyance section in the sheet width direction to orient the long sheet in the sheet width direction, and move the second conveyance section in a direction identical to a direction along which the first conveyance section is moved based on a detection result of the displacement detection section.

20 Claims, 5 Drawing Sheets

(58) Field of Classification Search
CPC ..... G03G 2215/00455; G03G 15/652; Y10T 74/19953; B65H 23/0216; B65H 23/038; B65H 18/145
See application file for complete search history.

(56) References Cited

U.S. PATENT DOCUMENTS

| | | | | |
|---|---|---|---|---|
| 8,737,890 | B2 * | 5/2014 | Nakamura | G03G 15/1605 198/806 |
| 2003/0053833 | A1 * | 3/2003 | Kinoshita | B41J 15/005 399/384 |
| 2006/0062618 | A1 * | 3/2006 | Kobayashi | G03G 15/0131 399/384 |
| 2007/0075479 | A1 * | 4/2007 | Obuchi | B65H 29/12 271/109 |

FOREIGN PATENT DOCUMENTS

| | | | |
|---|---|---|---|
| JP | 2007022680 | A | 2/2007 |
| JP | 2012-234031 | A | 11/2012 |
| JP | 2014058369 | A | 4/2014 |

* cited by examiner

IMAGE FORMING APPARATUS WITH A CONVEYANCE SECTION MOVABLE IN A WIDTH DIRECTION

CROSS REFERENCE TO RELATED APPLICATIONS

This application is entitled to and claims the benefit of Japanese Patent Application No. 2014-213627, filed on Oct. 20, 2014, the disclosure of which including the specification, drawings and abstract is incorporated herein by reference in its entirety.

BACKGROUND OF THE INVENTION

1. Field of the Invention

The present invention relates to an image forming apparatus and an image formation system.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, and then heat and pressure are applied to the sheet at a fixing nip to form an image on the sheet.

In addition, image formation systems have been practically used in which a sheet feeding apparatus that feeds a continuous sheet (hereinafter referred to as "long sheet") such as continuous roll paper and folded paper, and a winding apparatus that winds up the long sheet on which an image has been formed by the image forming apparatus are respectively connected at preceding and succeeding sides of the above-mentioned image forming apparatus.

In the above-mentioned image forming apparatus, when a sheet is conveyed to an image formation position from a sheet feeding section, the sheet may be displaced in a sheet width direction which is perpendicular to the sheet conveyance direction. Such displacement may be caused by, for example, nonuniformity in longitudinal diameter of a roller that conveys the sheet due to manufacturing error, variation in diameter of the roller due to aging degradation, and displacement of sheets stacked in a sheet feeding section. When such displacement occurs in the sheet width direction, the image may be formed at a position different from the position desired by the user during image formation.

Registration movement is known as a method for solving the above-mentioned problem, that is, as a method for accurately aligning the image and the sheet in consideration of the displacement of the sheet. Japanese Patent Application Laid-Open No. 2007-22680 discloses an exemplary registration movement. Japanese Patent Application Laid-Open No. 2007-22680 discloses a registration roller pair disposed at a position preceding the image formation position, and an optical sensor disposed in the vicinity of a position on the downstream side of the registration roller pair in the sheet conveyance direction. To be more specific, the registration roller pair can be moved with the sheet sandwiched therebetween, and are moved with the sheet sandwiched therebetween in the sheet width direction in accordance with the displacement amount of the sheet obtained by an optical sensor. Consequently, the displacement of the sheet in the sheet width direction is corrected, and thus the image and the sheet are aligned.

However, in the case where an image is formed on a long sheet in the above-mentioned image formation system, when the registration roller pair is moved in the sheet width direction in accordance with the displacement amount of the long sheet obtained by the optical sensor, the long sheet is twisted between a conveyance means located at a position on the downstream side of the registration roller pair in the sheet conveyance direction (for example, a roller pair that forms a fixing nip) and the registration roller pair. When the long sheet is twisted, the long sheet on which a toner image is fixed wrinkles, or the toner image formed on the long sheet is deformed.

SUMMARY OF THE INVENTION

An object of the present invention is to provide an image forming apparatus and an image formation system which can correct displacement of a long sheet in the sheet width direction while preventing twisting of the long sheet.

To achieve at least one of the abovementioned objects, an image forming apparatus reflecting one aspect of the present invention includes an image forming section configured to form a toner image on a long sheet at an image formation position, a first conveyance section disposed on an upstream side of the image formation position in a sheet conveyance direction of the long sheet, and configured to convey the long sheet to the image formation position, a second conveyance section disposed on a downstream side of the image formation position in the sheet conveyance direction, and configured to convey the long sheet on which the toner image is formed, a displacement detection section configured to detect displacement of the long sheet in a sheet width direction which is perpendicular to the sheet conveyance direction, and a control section configured to move the first conveyance section in the sheet width direction to orient the long sheet in the sheet width direction, and move the second conveyance section in a direction identical to a direction along which the first conveyance section is moved based on a detection result of the displacement detection section.

Desirably, in the image forming apparatus, the control section repeats moving and stopping of the first and second conveyance sections based on the detection result of the displacement detection section.

Desirably, in the image forming apparatus, the displacement detection section is disposed on the upstream side of the image formation position in the sheet conveyance direction.

Desirably, in the image forming apparatus, the displacement detection section is disposed at a position nearer to the image formation position relative to the first conveyance section in the sheet conveyance direction.

Desirably, in the image forming apparatus, wherein the control section changes movement speeds of the first and second conveyance sections in accordance with rigidity of the long sheet.

An image formation system reflecting one aspect of the present invention includes: a sheet feeding apparatus configured to feed a long sheet; an image forming apparatus configured to form an image on the long sheet fed from the sheet feeding apparatus, the image forming apparatus including: an image forming section configured to form a toner image on the long sheet at an image formation position, a first conveyance section disposed on an upstream side of the image formation position in a sheet conveyance direction of the long sheet, and configured to convey the long sheet to the image formation position, a second conveyance section disposed on a downstream side of the image formation position in the sheet conveyance direction, and configured to convey the long sheet on which the toner image is formed, a displacement detection section configured to detect displacement of the long sheet in a sheet width direction which is perpendicular to the sheet conveyance direction, and a control section configured to move the first conveyance section in the sheet width direction to orient the long sheet in the sheet width direction, and move the second conveyance section in a direction identical to a direction along which the first conveyance section is moved based on a detection result of the displacement detection section; and a winding apparatus configured to wind up the long sheet on which an image is formed by the image forming apparatus.

Desirably, in the image formation system, the control section repeats moving and stopping of the first and second conveyance sections based on the detection result of the displacement detection section.

Desirably, in the image formation system, the displacement detection section is disposed on the upstream side of the image formation position in the sheet conveyance direction.

Desirably, in the image formation system, the displacement detection section is disposed at a position nearer to the image formation position relative to the first conveyance section in the sheet conveyance direction.

Desirably, in the image formation system, the control section changes movement speeds of the first and second conveyance sections in accordance with rigidity of the long sheet.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
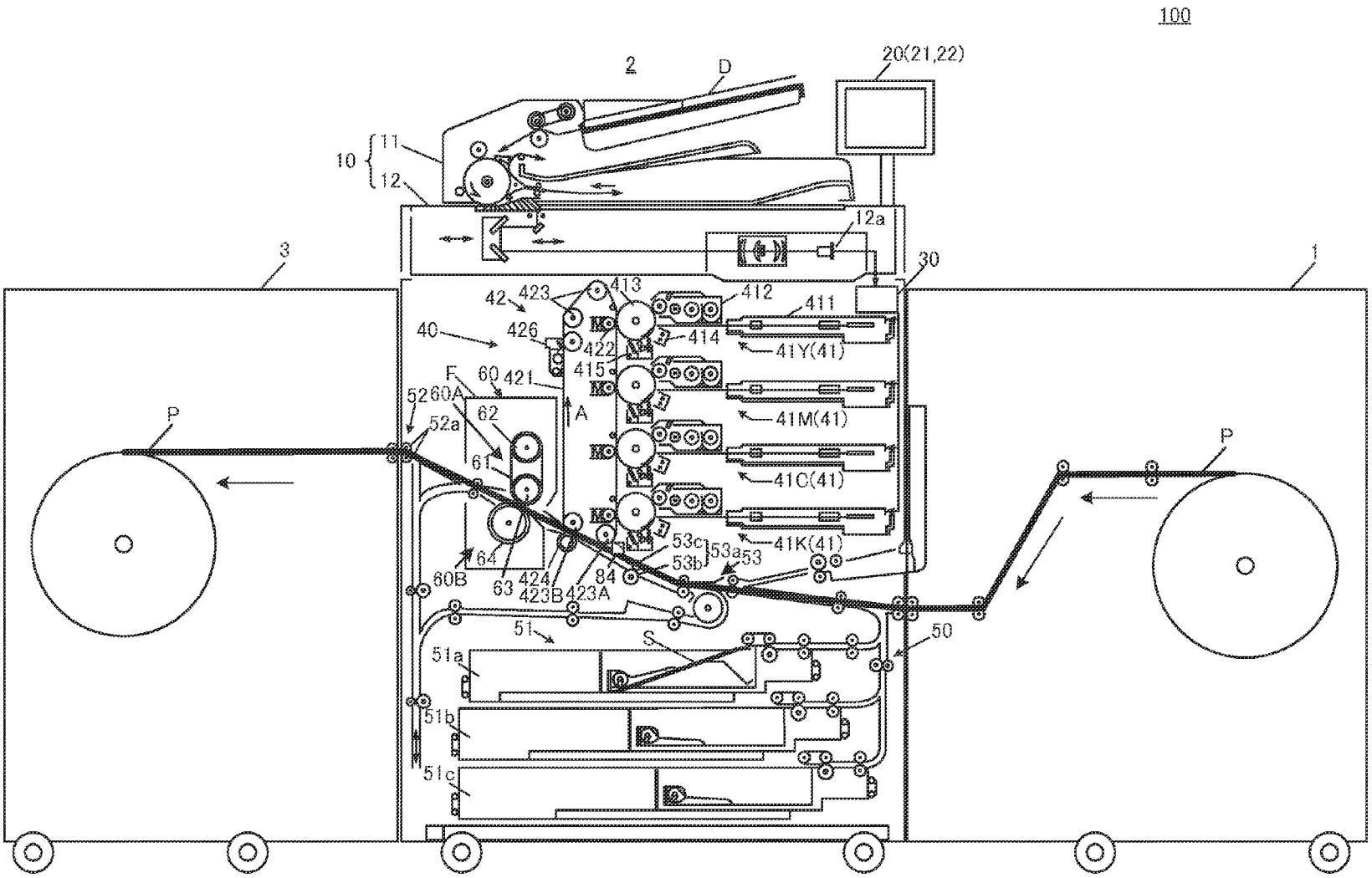
FIG. 1 schematically illustrates a general configuration of an image formation system of the present embodiment.
Figure 2:
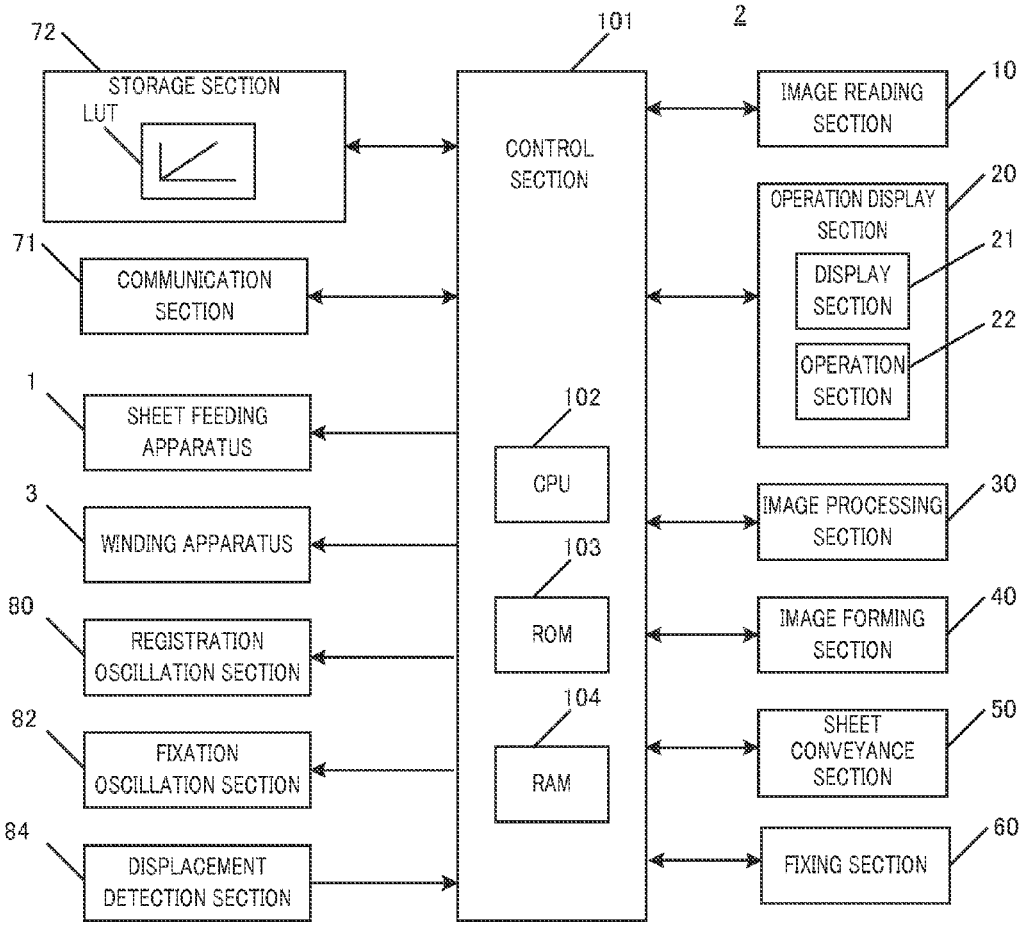
FIG. 2 illustrates a principal part of a control system of the image forming apparatus of the present embodiment.

In the following, the present embodiment is described in detail with reference to the drawings. FIG. 1 schematically illustrates a general configuration of image forming system 100 according to an embodiment of the present invention. FIG. 2 illustrates a principal part of a control system of image forming apparatus 2 of image formation system 100 according to the present embodiment. Image forming system 100 uses long sheet P or sheet S (non-long sheet) indicated with the heavy line in FIG. 1 as a recording medium, and forms an image on long sheet P or sheet S. Here, long sheet P is a sheet which has a length a greater than the width of the main body of image forming apparatus 2 in the conveyance direction, for example.

As illustrated in FIG. 1, in image forming system 100, sheet feeding apparatus 1, image forming apparatus 2 and winding apparatus 3 are connected to each other from the upstream side in the conveyance direction of long sheet P (hereinafter referred to also as "sheet conveyance direction"). Sheet feeding apparatus 1 and winding apparatus 3 are used when an image is formed on long sheet P.

Sheet feeding apparatus 1 is an apparatus for feeding long sheet P to image forming apparatus 2. As illustrated in FIG. 1, in the housing of sheet feeding apparatus 1, roll-shaped long sheet P is wound around a support shaft and is rotatably held. Sheet feeding apparatus 1 conveys, via a plurality of conveyance roller pairs (for example, delivery rollers, sheet feed rollers and the like), long sheet P wound around the support shaft to image forming apparatus 2 at a constant speed. The sheet feeding operation of sheet feeding apparatus 1 is controlled by control section 101 of image forming apparatus 2.

It is to be noted that, in sheet feeding apparatus 1, long sheet P may not be held in a roll shape, and a plurality of long sheets P of a predetermined size (for example, 210 [mm]×1200 [mm]) may be held.

Image forming apparatus 2 is a color-image forming apparatus of an intermediate transfer system using electrophotographic process technology. That is, image forming apparatus 2 primary-transfers toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 secondary-transfers the resultant image to long sheet P fed from sheet feeding apparatus 1 or sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60 and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on long sheet P or sheet S based on the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data based on a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Controls display section 21 to displays various operation screens, image conditions, operating statuses of functions, and the like in accordance with display control signals received from control section 101. Operation section 22 includes various operation keys such as numeric keys and a start key, receives various input operations performed by a user, and outputs operation signals to control section 101.

Image processing section 30 includes a circuit that performs a digital image process suited to initial settings or user settings on the input image data, and the like. For example, image processing section 30 performs tone correction based on tone correction data (tone correction table), under the control of control section 101. In addition to the tone correction, image processing section 30 also performs various correction processes such as color correction and shading correction as well as a compression process, on the input image data.

Image forming section 40 is controlled based on the image data that has been subjected to these processes.

Image forming section 40 includes: image forming units 41Y, 41M, 41C, and 41K that form images of colored toners of a Y component, an M component, a C component, and a K component based on the input image data; intermediate transfer unit 42; and the like.

Image forming units 41Y, 41M, 41C, and 41K for the Y component, the M component, the C component, and the K component have a similar configuration.

For ease of illustration and description, common elements are denoted by the same reference signs. Only when elements need to be discriminated from one another, Y, M, C, or K is added to their reference signs.

In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm] The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to long sheet P or sheet S is formed. The position of the secondary transfer nip in the sheet conveyance direction corresponds to the "image formation position" of the embodiment of the present invention.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when long sheet P or sheet S passes through the secondary transfer nip, the toner image on intermediate transfer belt 421 is secondary-transferred to long sheet P or sheet S. To be more specific, a secondary transfer bias is applied to secondary transfer roller 424, and an electric charge of the polarity opposite to the polarity of the toner is applied to the rear side (the side that makes contact with secondary transfer roller 424) of long sheet P or sheet S, whereby the toner image is electrostatically transferred to long sheet P or sheet S. Long sheet P or sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes: upper fixing section 60A having a fixing side member disposed on a fixing surface (the surface on which a toner image is formed) side of long sheet P or sheet S; lower fixing section 60B having a back side supporting member disposed on the rear surface (the surface opposite to the fixing surface) side of long sheet P or sheet S; and the like. The back side supporting member is brought into pressure contact with the fixing side member, whereby a fixing nip for conveying long sheet P or sheet S in a tightly sandwiching manner is formed.

Fixing section 60 applies, at the fixing nip, heat and pressure to long sheet P or sheet S on which a toner image has been secondary-transferred, thereby fixing the toner image on long sheet P or sheet S. Fixing section 60 is disposed as a unit in fixing part F. In addition, fixing part F may be provided with an air-separating unit that blows air to separate long sheet P or sheet S from the fixing side member or the back side supporting member.

Upper fixing section 60A includes endless fixing belt 61, heating roller 62 and fixing roller 63, which serve as a fixing side member (belt heating system). Fixing belt 61 is installed in a stretched state around heating roller 62 and fixing roller 63 with a predetermined belt tensile force (for example, 40 [N]).

Fixing belt 61 makes contact with long sheet P or sheet S on which a toner image is formed, and thermally fixes the toner image on long sheet P or sheet S at a fixation temperature (for example, 160 to 200[° C.]). The fixing temperature is a temperature at which a heat energy required for melting the toner on long sheet P or sheet S can be obtained, and the fixing temperature differs depending on factors such as the type of long sheet P or sheet S on which an image is to be formed.

Heating roller 62 incorporates a heating source (halogen heater) and applies heat to fixing belt 61. The temperature of a heating source is controlled by control section 101. The heating source applies heat to heating roller 62, and as a result, fixing belt 61 is heated.

Fixing roller 63 is driven and controlled (for example, turn on/off of rotation, circumferential velocity, and the like) by control section 101. Control section 101 rotates fixing roller 63 in the clockwise direction. When fixing roller 63 rotates, fixing belt 61 and heating roller 62 rotate in the clockwise direction to follow the rotation of fixing roller 63.

Lower fixing section 60B includes pressure roller 64 serving as a back side supporting member (roller pressing type). Pressure roller 64 has a structure in which an elastic layer made of silicone rubber or the like and a surface layer composed of a PFA-tube are sequentially formed on the outer peripheral surface of a cylindrical mandrel made of iron or the like, for example. Pressure roller 64 is brought into pressure contact with fixing roller 63 with fixing belt 61 therebetween with a predetermined fixing load (for example, 1000 [N]) by a pressure contact separation section (not illustrated). The pressure contact separation section has a conventional configuration, and brings fixing belt 61 and pressure roller 64 into pressure contact with each other or separates fixing belt 61 and pressure roller 64 from each other. Thus, a fixing nip for conveying sheet S in a tightly sandwiching manner is formed between fixing belt 61 and pressure roller 64. Pressure roller 64 and the pressure contact separation section are driven and controlled (for example, on/off of rotation, circumferential velocity, and the like) by control section 101. Control section 101 rotates pressure roller 64 in the counterclockwise direction. It is to be noted that upper fixing section 60A and lower fixing section 60B correspond to the "second conveyance section" of the embodiment of the present invention.

In the present embodiment, fixing section 60 includes fixation oscillation section 82 that moves upper fixing section 60A and lower fixing section 60B in the sheet width direction perpendicular to the sheet conveyance direction. Fixation oscillation section 82 is composed of a drive motor (not illustrated), and a power transmission (not illustrated) such as a rack-and-pinion, for example.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated based on the basis weight, the size, and the like, for each type set in advance. Conveyance path section 53 includes a plurality of pairs of conveyance rollers including registration roller pair 53*a* (which corresponds to the "first conveyance section" of the embodiment of the present invention).

A registration roller section in which registration roller pair 53*a* is arranged corrects skew and displacement of sheet S or long sheet P. Registration roller pair 53*a* includes registration drive roller 53*b* connected with the drive motor, and registration driven roller 53*c* disposed to face registration drive roller 53*b*. When registration driven roller 53*c* is brought into pressure contact with registration drive roller 53*b*, a registration nip section for conveying sheet S or long sheet P in a tightly sandwiching manner is formed. Registration driven roller 53*c* is kept in a state where it is in pressure contact with registration drive roller 53*b* at all times. The sheet conveyance operation (operation for driving the registration drive roller into rotation) of the registration roller section is controlled by control section 101.

In addition, the registration roller section includes registration oscillation section 80 that moves registration drive roller 53*b* and registration driven roller 53*c* in the sheet width direction (the axis direction of registration drive roller 53*b*) to correct displacement (the position in the sheet width direction) of sheet S or long sheet P. Registration oscillation section 80 is composed of the drive motor (not illustrated), a power transmission section (not illustrated) such as a rack-and-pinion, for example.

Figure 3:
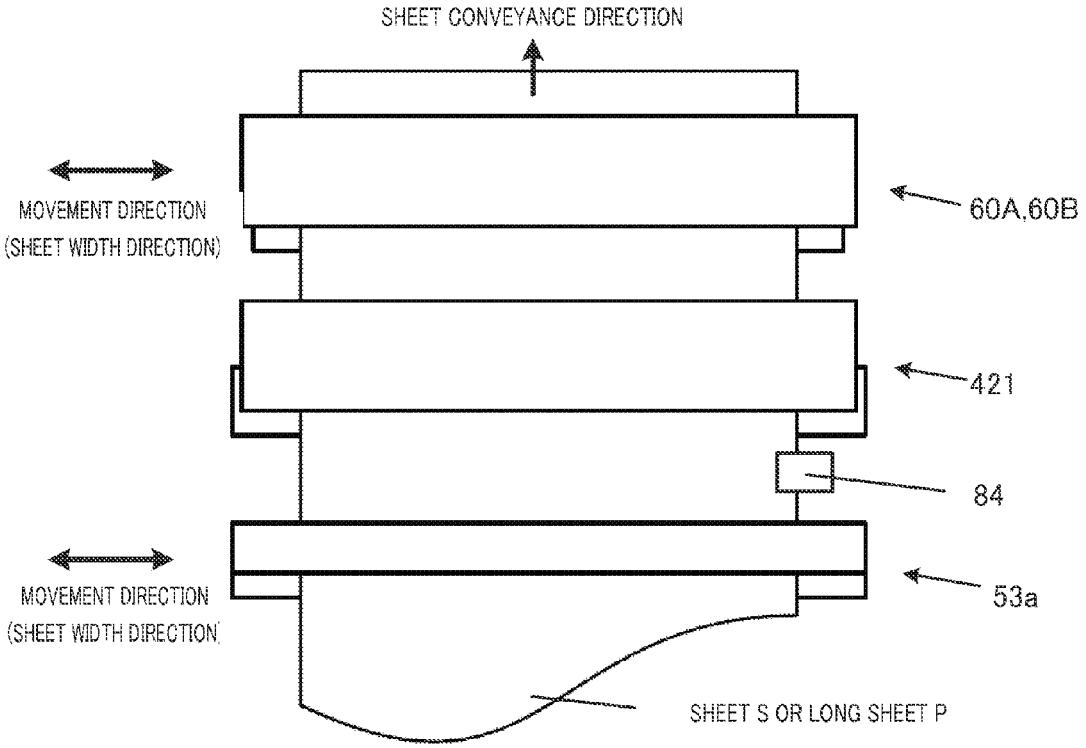
FIG. 3 is an explanatory view of a position a displacement detection section of the present embodiment.

In addition, as illustrated in FIG. 3, displacement detection section 84 that detects displacement of sheet S or long sheet P in the sheet width direction is disposed at a position on the downstream side of registration roller pair 53*a*, and on the upstream side of intermediate transfer belt 421 in the sheet conveyance direction. In the present embodiment, displacement detection section 84 is disposed at a position near a right end portion of sheet S or long sheet P in the sheet width direction to detect a fact that the right end portion has reached a predetermined position, that is, a fact that displacement of sheet S or long sheet P has occurred. Alternatively, displacement detection section 84 may be disposed at a position near a left end portion of sheet S or long sheet P in the sheet width direction to detect a fact that the left end portion has reached a predetermined position, that is, a fact that displacement of sheet S or long sheet P has occurred.

Figure 4A:
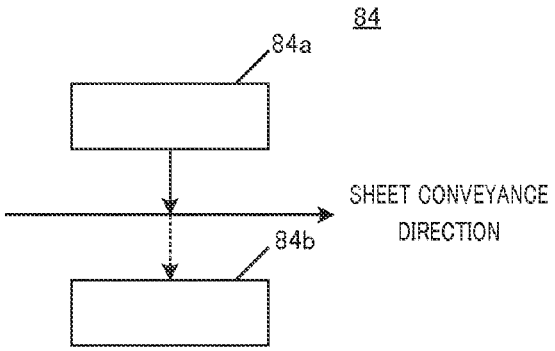
FIGS. 4A, 4B, 4C, and 4D illustrate a configuration of the displacement detection section of the present embodiment.

As illustrated in FIG. 4A, displacement detection section 84 is composed of a transmission-type laser sensor including light emission section 84*a* that emits laser light, and light receiving section 84*b* that receives the laser light emitted by light emission section 84*a*, for example. When the right end portion of sheet S or long sheet P in the sheet width direction has not reached a predetermined position, laser light emitted by light emission section 84*a* is received by light receiving section 84*b*. When the right end portion of sheet S or long sheet P in the sheet width direction has reached the predetermined position, laser light emitted by light emission section 84*a* is blocked by sheet S or long sheet P and is not received by light receiving section 84*b*. In this case, displacement detection section 84 detects that displacement of sheet S or long sheet P has occurred.

Figure 4B:
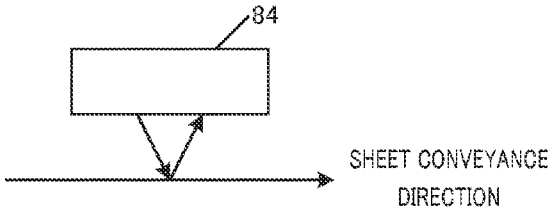

As illustrated in FIG. 4B, displacement detection section 84 may be composed of a reflection type-laser sensor including a light emission section that emits laser light, and a light receiving section that receives the laser light emitted by the light emission section and reflected by sheet S or long sheet P that is a detection object. When the right end portion of sheet S or long sheet P in the sheet width direction has not reached a predetermined position, the laser light emitted by light emission section is not reflected by sheet S or long sheet P and is not received by the light receiving section. When the right end portion of sheet S or long sheet P in the sheet width direction has reached the predetermined position, the laser light emitted by the light emission section is reflected by sheet S or long sheet P and received by light receiving section 84*b*. In this case, displacement detection section 84 detects occurrence of displacement of sheet S or long sheet P.

Figure 4C:
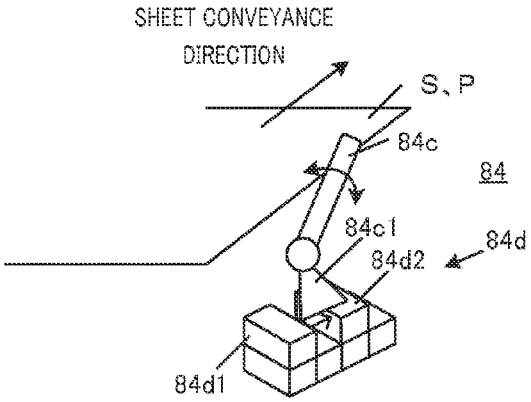

As illustrated in FIG. 4C, displacement detection section 84 may be composed of: actuator 84*c* that makes contact with the right end portion of sheet S or long sheet P in the sheet width direction and oscillates in the arrow direction in accordance with the position of the right end portion in the sheet width direction; and photosensor 84*d* that detects oscillation of actuator 84*c* using a technique similar to that of a transmission-type laser sensor. Base end 84*c*1 of actuator 84*c* is disposed between light emission section 84*d*1 and light receiving section 84*d*2 of photosensor 84*d*. When the right end portion of sheet S or long sheet P in the sheet width direction has not reached the predetermined position, the right end portion of sheet S or long sheet P in the sheet width direction is not in contact with actuator 84*c*, that is, actuator 84*c* does not oscillate, and thus, the laser light emitted by light emission section 84*d*1 is received by light receiving section 84*d*2 without being blocked by base end 84*c*1 of actuator 84*c*. When the right end portion of sheet S or long sheet P in the sheet width direction has reached the predetermined position, the right end portion of sheet S or long sheet P in the sheet width direction makes contact with actuator 84*c*, that is, actuator 84*c* oscillates, and thus, the laser light emitted by light emission section 84*d*1 is not received by light receiving section 84*d*2 by being blocked by base end 84*c*1*df* actuator 84*c*. In this case, displacement detection section 84 detects occurrence of displacement of sheet S or long sheet P.

Figure 4D:
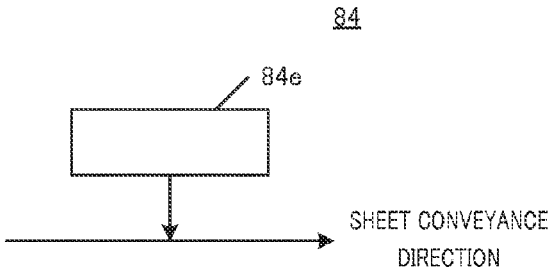

As illustrated in FIG. 4D, displacement detection section 84 may be composed of: CCD camera 84*e* that captures an image of the right end portion of sheet S or long sheet P in the sheet width direction; and an image processing section (not illustrated) that applies a predetermined image processing on the image captured by CCD camera 84*e*. Based on the results of the processing by the image processing section, displacement detection section 84 can detect a fact that the right end portion of sheet S or long sheet P in the sheet width direction has reached the predetermined position, that is, a fact that displacement of sheet S or long sheet P has occurred. In addition, displacement detection section 84 can calculate the movement speed of the right end portion of sheet S or long sheet P in the sheet width direction based on the results of the processing by the image processing section.

As described above, the method of detecting the position of the right end portion of sheet S or long sheet P in the sheet width direction may either be a contacting method or non-contacting method. When the contacting method is adopted for the detection, the configuration of displacement detection section 84 can be simplified, and when the non-contacting method is adopted for the detection, the position of sheet S or long sheet P in the sheet width direction can be accurately detected.

Based on the detection result of displacement detection section 84, control section 101 controls registration oscillation section 80. In registration oscillation section 80, the rotational movement of the drive motor (not illustrated) is converted into linear movement by the power transmission section (not illustrated), and the movement is transmitted to registration drive roller 53*b* and registration driven roller 53*c*. Thus, registration drive roller 53*b* and registration driven roller 53*c* move in the sheet width direction. Registration drive roller 53*b* and registration driven roller 53*c* oscillate in the sheet width direction while being rotated, that is, while conveying sheet S or long sheet P, whereby the position of sheet S or long sheet P in the sheet width direction is corrected.

The recording sheets S stored in sheet tray units 51*a* to 51*c* are output one by one from the uppermost, and conveyed to image forming section 40 by conveyance path section 53. In image forming section 40, the toner image on intermediate transfer belt 421 is secondary-transferred to one side of sheet S at one time, and a fixing process is performed in fixing section 60. Long sheet P fed from sheet feeding apparatus 1 to image forming apparatus 2 is conveyed to image forming section 40 by conveyance path section 53. Then, in image forming section 40, the toner image on intermediate transfer belt 421 is secondary-transferred to one side of long sheet P at one time, and a fixing process is performed in fixing section 60. Long sheet P or sheet S on which an image has been formed is conveyed to winding apparatus 3 by sheet ejection section 52 having conveyance roller pair (sheet ejection roller pair) 52*a*.

Winding apparatus 3 is an apparatus for winding up long sheet P conveyed from image forming apparatus 2. As illustrated in FIG. 1, in the housing of winding apparatus 3, long sheet P is wound around a support shaft and held in a roll shape for example. As such, winding apparatus 3 winds up long sheet P which is conveyed from image forming apparatus 2 via a plurality of conveyance roller pairs (for example, delivery rollers and sheet ejection rollers) around the support shaft at a constant speed. The winding operation of winding apparatus 3 is controlled by control section 101 of image forming apparatus 2.

In the above-described image formation system 100, during image formation on long sheet P, control section 101 moves registration roller pair 53*a* in the direction opposite to a direction of the displacement in the sheet width direction to orient long sheet P in the sheet width direction, and moves upper fixing section 60A and lower fixing section 60B of fixing section 60 in the direction identical to the movement direction of registration roller pair 53*a* based on the detection result of displacement detection section 84 to correct displacement of long sheet P in the sheet width direction. With this configuration, it is possible to solve problems specific to long sheet P having no sheet interval unlike sheet S that is cut paper, that is, it is possible to solve a problem of occurrence of twist of long sheet P with respect to a conveyer (upper fixing section 60A and lower fixing section 60B) disposed at a position on the downstream side of registration roller pair 53*a* in the sheet conveyance direction at the time of oscillation of registration roller pair 53*a* in the sheet width direction. Consequently, it is possible to prevent wrinkles of long sheet P on which a toner image has been fixed, and deformation of a toner image formed on long sheet P which may be caused by twist of long sheet P.

Figure 5:
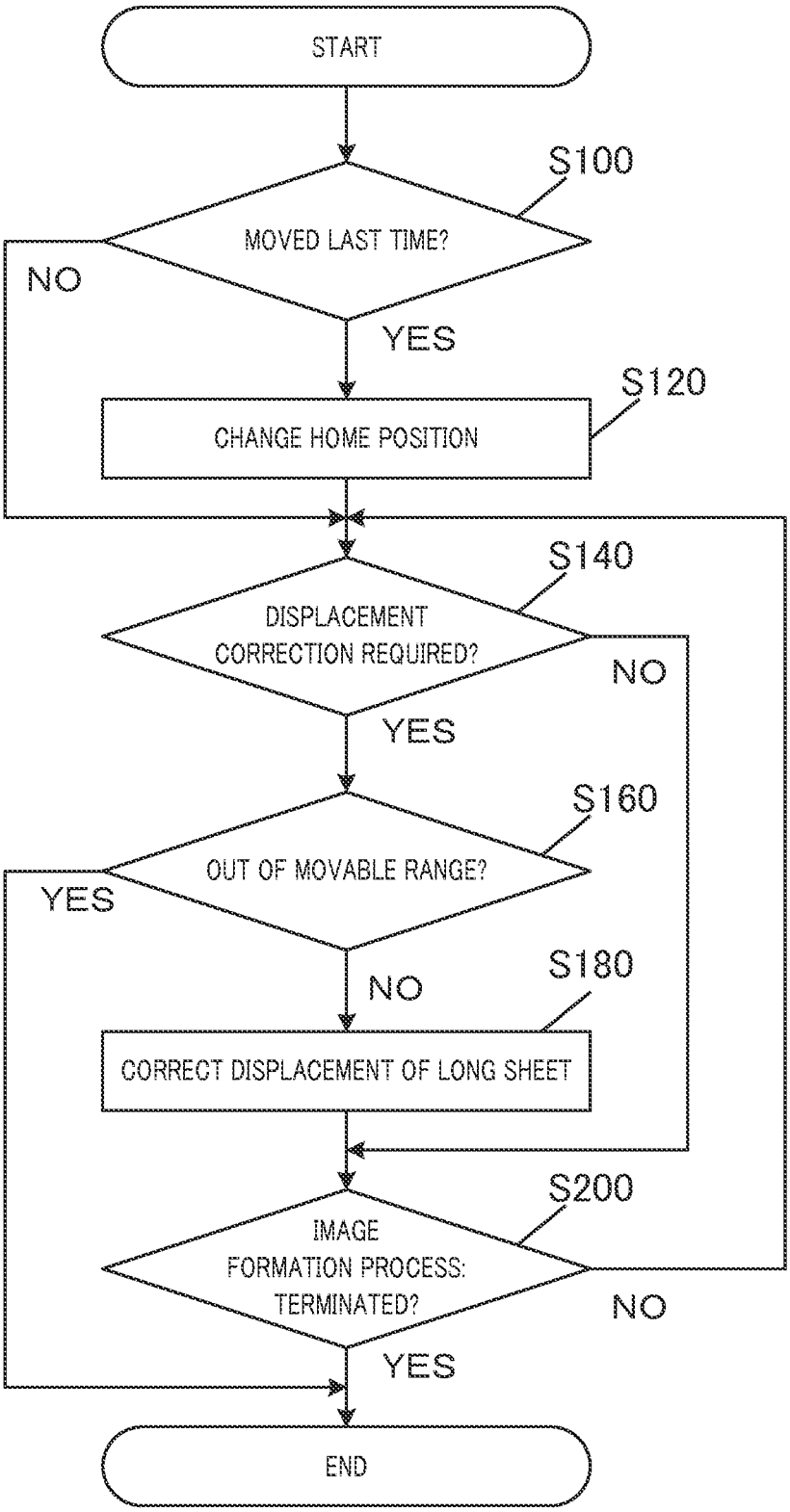
FIG. 5 is a flowchart of a control operation of the image formation system of the present embodiment.

Next, referring to the flowchart of FIG. 5, an operation for correcting displacement of long sheet P in sheet width direction during image formation on long sheet P will be described. The processes in FIG. 5 are executed every time when the image formation process on long sheet P which corresponds to one printing job is executed in image formation system 100, for example.

First, control section 101 determines whether registration roller pair 53*a*, upper fixing section 60A and lower fixing section 60B have been moved in the sheet width direction to correct skew and displacement of long sheet P in the image formation process on long sheet P that corresponds to the last printing job (step S100). When it is determined that registration roller pair 53*a*, upper fixing section 60A and lower fixing section 60B have not been moved in the sheet width direction (NO in step S100), the process is advanced to step S140.

When registration roller pair 53*a*, upper fixing section 60A and lower fixing section 60B have been moved in the sheet width direction (YES in step S100), control section 101 changes the home positions (initial positions before the start of the image formation process) of registration roller pair 53*a*, upper fixing section 60A and lower fixing section 60B (step S120).

To be more specific, control section 101 moves registration roller pair 53*a*, upper fixing section 60A and lower fixing section 60B in the direction opposite to the direction in which registration roller pair 53*a*, upper fixing section 60A and lower fixing section 60B have been moved in the last printing job in order to increase a movable range within which registration roller pair 53*a*, upper fixing section 60A and lower fixing section 60B can be moved for correcting the displacement of long sheet P in the image formation process corresponding to the present printing job. For example, when registration roller pair 53*a*, upper fixing section 60A and lower fixing section 60B have been moved leftward in the sheet width direction in the last printing job, the movable range within which registration roller pair 53*a*, upper fixing section 60A and lower fixing section 60B can be moved leftward is small in comparison with the rightward in the present printing job. Therefore, registration roller pair 53*a*, upper fixing section 60A and lower fixing section 60B are moved rightward such that registration roller pair 53*a*, upper fixing section 60A and lower fixing section 60B can be moved by the same distance in the right and left directions in the sheet width direction in the present printing job. It is to be noted that the moving directions of registration roller pair 53*a*, upper fixing section 60A and lower fixing section 60B in the last printing job is stored in storage section 72 for example.

Next, control section 101 acquires a detection result of displacement detection section 84, and determines whether it is necessary to correct the displacement of long sheet P in the sheet width direction based on the detection result (step S140). When it is determined that the right end portion of long sheet P in the sheet width direction has reached a predetermined position from the detection result of displacement detection section 84, control section 101 determines that displacement of long sheet P in the sheet width direction correction is required. When it is determined that displacement of long sheet P is not required to be corrected (NO in step S140), the process is advanced to step S200. On the other hand, when displacement of long sheet P is required to be corrected (YES in step S140), control section 101 determines whether the range of movement of registration roller pair 53*a*, upper fixing section 60A and lower fixing section 60B to correct the displacement falls within the movable range (step S160). When it is determined that the movement falls outside the movable range (YES in step S160), image formation system 100 terminates the processing of FIG. 5. When the movement falls outside the movable range of registration roller pair 53*a*, upper fixing section 60A and lower fixing section 60B, that is, the range within which displacement of long sheet P can be corrected, it is desirable to issue an alert indicating such a situation, or to stop the image formation process. One reason for this is to prevent breaking of long sheet P, and sheet jam (clogging of long sheet P being conveyed in the sheet conveyance path) which may be caused when the image formation process is continued in that situation.

On the other hand, when the movement falls within the movable range (NO in step S160), control section 101 operates to correct displacement of long sheet P in the sheet width direction (step S180). That is, control section 101 moves registration roller pair 53*a* in the direction opposite to the direction of the displacement in the sheet width direction based on a detection result of displacement detection section 84 to orient long sheet P in the sheet width direction, and moves upper fixing section 60A and lower fixing section 60B in a direction identical to the movement direction of registration roller pair 53*a*. Based on image data, control section 101 moves registration roller pair 53*a*, upper fixing section 60A and lower fixing section 60B at a timing when a position of an interval between images to be formed on long sheet P reaches the position of the secondary transfer nip in the sheet conveyance direction. One reason for this is to surely prevent images from being formed at a position different from the position desired by the user in image formation. The distances by which registration roller pair 53*a*, upper fixing section 60A and lower fixing section 60B are moved are set in accordance with the distance by which the right end portion of long sheet P in the sheet width direction goes beyond the predetermined position.

Finally, control section 101 determines whether the image formation process on long sheet P of the present printing job has been completed (step S200). When it is determined that the image formation process on long sheet P has not been completed (NO in step S200), the process is returned to step S140. On the other hand, when the image formation process on long sheet P has been completed (YES in step S200), image formation system 100 terminates the processing of FIG. 5. In this manner, in the flowchart of FIG. 5, control section 101 repeats moving and stopping of registration roller pair 53*a*, upper fixing section 60A and lower fixing section 60B based on a detection result of displacement detection section 84.

As has been described in detail, in the present embodiment, image forming apparatus 2 includes: image forming section 40 configured to form a toner image on long sheet P at an image formation position; registration roller pair 53*a* disposed on an upstream side of the image formation position in a sheet conveyance direction of the long sheet P, and configured to convey the long sheet P to the image formation position; upper fixing section 60A and lower fixing section 60B disposed on a downstream side of the image formation position in the sheet conveyance direction, and configured to convey long sheet P on which the toner image is formed; displacement detection section 84 configured to detect displacement of long sheet P in a sheet width direction which is perpendicular to the sheet conveyance direction; and control section 101 configured to move registration roller pair 53*a* in the sheet width direction to orient the long sheet P in the sheet width direction, and move upper fixing section 60A and lower fixing section 60B in a direction identical to a direction along which registration roller pair 53*a* is moved based on a detection result of displacement detection section 84.

According to the above-mentioned configuration of the present embodiment, displacement of long sheet P is corrected such that the relative position in sheet width direction among registration roller pair 53*a*, upper fixing section 60A and lower fixing section 60B is not changed, and consequently it is possible to prevent long sheet P from being twisted in the area of registration roller pair 53*a*, upper fixing section 60A and lower fixing section 60B.

While upper fixing section 60A and lower fixing section 60B correspond to the "second conveyance section" of the embodiment of the present invention in the above-mentioned embodiment, any conveyance sections may be adopted as long as the section is disposed on the downstream side of the image formation position in the sheet conveyance direction, and is configured to convey long sheet P on which an toner image is formed.

While displacement detection section 84 is disposed at a position on the downstream side of registration roller pair 53*a* and on the upstream side of intermediate transfer belt 421 in the sheet conveyance direction in the above-mentioned embodiment, displacement detection section 84 may be disposed on the downstream side of intermediate transfer belt 421. In view of accurate correction of displacement of long sheet P in the sheet width direction, it is preferable to dispose displacement detection section 84 on the upstream side of intermediate transfer belt 421 rather than on the downstream side of intermediate transfer belt 421. For the same reason, it is preferable to dispose displacement detection section 84 at a position nearer to the image formation position relative to registration roller pair 53*a* in the sheet conveyance direction. It is also possible to dispose displacement detection sections 84 on both of the upstream side and the downstream side of registration roller pair 53*a* in the sheet conveyance direction.

In addition, in the above-mentioned embodiment, control section 101 may change the movement speed of registration roller pair 53*a*, upper fixing section 60A and lower fixing section 60B in accordance with the rigidity (sheet type, basis weight, sheet width) of long sheet P. For example, control section 101 reduces the movement speed of registration roller pair 53*a*, upper fixing section 60A and lower fixing section 60B in the case where the rigidity of long sheet P is high because of the sheet type which is rigid (plain paper, label paper), thick paper, narrow width and the like, in comparison with the case where the rigidity of long sheet P is small because of the sheet type which is not rigid (coated paper, resin sheet), thin paper, wide width and the like. With this configuration, registration roller pair 53*a*, upper fixing section 60A and lower fixing section 60B can be moved without causing positional shift among registration roller pair 53*a*, upper fixing section 60A and lower fixing section 60B in the sheet conveyance direction, and in turn, without causing twist of long sheet P. As a result, it is possible to prevent generation of image noise at the time when a toner image is transferred to long sheet P at the secondary transfer nip.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The invention claimed is:

1. An image forming apparatus comprising:

an image forming section configured to form a toner image on a long sheet at an image formation position;

a first conveyance section disposed on an upstream side of the image formation position in a sheet conveyance direction of the long sheet, and configured to convey the long sheet to the image formation position;

a second conveyance section disposed on a downstream side of the image formation position in the sheet conveyance direction, and configured to convey the long sheet on which the toner image is formed;

a displacement detection section configured to detect displacement of the long sheet in a sheet width direction which is perpendicular to the sheet conveyance direction; and a control section configured to move the first conveyance section and the second conveyance section in the same sheet width direction to orient the long sheet being conveyed by the first conveyance section and the second conveyance section in the sheet width direction, based on a detection result of the displacement detection section.

2. The image forming apparatus according to claim 1, wherein the control section repeats moving and stopping of the first and second conveyance sections based on the detection result of the displacement detection section.

3. The image forming apparatus according to claim 1, wherein the displacement detection section is disposed on the upstream side of the image formation position in the sheet conveyance direction.

4. The image forming apparatus according to claim 1, wherein the displacement detection section is disposed at a position nearer to the image formation position relative to the first conveyance section in the sheet conveyance direction.

5. The image forming apparatus according to claim 1, wherein the control section changes movement speeds of the first and second conveyance sections in accordance with rigidity of the long sheet.

6. An image formation system comprising:

a sheet feeding apparatus configured to feed a long sheet;

an image forming apparatus configured to form an image on the long sheet fed from the sheet feeding apparatus, the image forming apparatus including:

an image forming section configured to form a toner image on the long sheet at an image formation position, a first conveyance section disposed on an upstream side of the image formation position in sheet conveyance direction of the long sheet, and configured to convey the long sheet to the image formation position, a second conveyance section disposed on a downstream side of the image formation position in the sheet conveyance direction, and configured to convey the long sheet on which the toner image is formed, a displacement detection section configured to detect displacement of the long sheet in a sheet width direction which is perpendicular to the sheet conveyance direction, and a control section configured to move the first conveyance section and the second conveyance section in the sheet width direction to orient the long sheet being conveyed by the first conveyance section and the second conveyance section in the sheet width direction based on a detection result of the displacement detection section; and a winding apparatus configured to wind up the long sheet on which an image is formed by the image forming apparatus.

7. The image formation system according to claim 6, wherein the control section repeats moving and stopping of the first and second conveyance sections based on the detection result of the displacement detection section.

8. The image formation system according to claim 6, wherein the displacement detection section is disposed on the upstream side of the image formation position in the sheet conveyance direction.

9. The image formation system according to claim 6, wherein the displacement detection section is disposed at a position nearer to the image formation position relative to the first conveyance section in the sheet conveyance direction.

10. The image formation system according to claim 6, wherein the control section changes movement speeds of the first and second conveyance sections in accordance with rigidity of the long sheet.

11. An image forming apparatus comprising:

an image forming section configured to form a toner image on a long sheet at an image formation position;

a first conveyance section disposed on an upstream side of the image formation position in a sheet conveyance direction of the long sheet, and configured to convey the long sheet to the image formation position;

a second conveyance section disposed on a downstream sice of the image formation position in the sheet conveyance direction, and configured to convey the long sheet on which the toner image is formed;

displacement detection section configured to detect displacement of the long sheet in a sheet width direction which is perpendicular to the sheet conveyance direction; and a control section configured to move the first conveyance section in the sheet width direction to orient the long sheet in the sheet width direction, and move the second conveyance section in a direction identical to a direction along which the first conveyance section is moved based on a detection result of the displacement detection section wherein the image forming section includes a fixing section with an upper fixing section and a lower fixing section, the second conveyance section being formed by the upper fixing section and the lower fixing section of the fixing section.

12. The image forming apparatus according to claim 1, wherein the first conveyance section comprises a registration roller pair upstream of the image forming section arranged it to correct SKU and displacement of the long sheet.

13. The image forming apparatus according to claim 1, wherein the displacement detection section includes a light emission section and a light receiving section disposed to receive light emitted by the light emission section.

14. The image forming apparatus according to claim 1, wherein the displacement detection section includes a light emission section and a light receiving section disposed to receive light emitted by the light emission section and reflected by the long sheet.

15. The image forming apparatus according to claim 1, wherein the displacement detection section includes an actuator that contacts an end portion of the long sheet in the sheet width direction.

16. The image forming apparatus according to claim 1, wherein the displacement detection section includes a CCD camera.

17. The image forming apparatus according to claim 11, wherein the control section repeats moving and stopping of the first and second conveyance sections based on the detection result of the displacement detection section.

18. The image forming apparatus according to claim 11, wherein the displacement detection section is disposed on the upstream side of the image formation position in the sheet conveyance direction.

19. The image forming apparatus according to claim 11, wherein the displacement detection section is disposed at a position nearer to the image formation position relative to the first conveyance section in the sheet conveyance direction.

20. The image forming apparatus according to claim 11, wherein the control section changes movement speeds of the first and second conveyance sections in accordance with rigidity of the long sheet.

* * * * *